US010757993B2

(12) United States Patent
Son

(10) Patent No.: US 10,757,993 B2
(45) Date of Patent: Sep. 1, 2020

(54) CAP WITH EXCHANGEABLE VISOR

(71) Applicant: Jounghoo Son, Seoul (KR)

(72) Inventor: Jounghoo Son, Seoul (KR)

( * ) Notice: Subject to any disclaimer, the term of this patent is extended or adjusted under 35 U.S.C. 154(b) by 0 days.

(21) Appl. No.: 16/207,302

(22) Filed: Dec. 3, 2018

(65) Prior Publication Data

US 2019/0297981 A1 Oct. 3, 2019

(30) Foreign Application Priority Data

Apr. 3, 2018 (KR) ..... 10-2018-0038569

(51) Int. Cl.

| | |
|---|---|
| ***A42B 1/06*** | (2006.01) |
| ***A42B 1/20*** | (2006.01) |
| ***A42B 1/00*** | (2006.01) |
| ***A42B 1/02*** | (2006.01) |

(52) U.S. Cl.

CPC ..... *A42B 1/206* (2013.01); *A42B 1/006* (2013.01); *A42B 1/02* (2013.01); *A42B 1/064* (2013.01); *A42B 1/205* (2013.01)

(58) Field of Classification Search

CPC ..... A42B 1/064; A42B 1/205; A42B 1/20
See application file for complete search history.

(56) References Cited

U.S. PATENT DOCUMENTS

| | | | | |
|---|---|---|---|---|
| 4,023,212 | A * | 5/1977 | Huffman | A42B 1/205 2/195.2 |
| 5,070,545 | A * | 12/1991 | Tapia | A42B 1/064 2/10 |
| 5,471,684 | A * | 12/1995 | Casale | A42B 1/064 2/10 |
| 5,715,534 | A * | 2/1998 | Mobley | A42B 1/064 2/10 |
| 6,263,508 | B1 * | 7/2001 | Davis | A42B 1/064 2/10 |
| 10,219,569 | B2 * | 3/2019 | Olivera, II | A42B 1/062 |
| 2002/0000001 | A1 * | 1/2002 | Hall Mckenzie | A42B 1/064 2/195.2 |
| 2004/0040067 | A1 * | 3/2004 | Pong | A42B 1/22 2/195.2 |
| 2007/0017003 | A1 * | 1/2007 | Harris | A42B 1/064 2/195.1 |
| 2015/0189938 | A1 * | 7/2015 | Reinhart | A42B 1/064 2/195.2 |
| 2017/0347733 | A1 * | 12/2017 | Durand, Jr. | A42B 1/064 |
| 2018/0000180 | A1 * | 1/2018 | Gholson | A42B 1/205 |

FOREIGN PATENT DOCUMENTS

| | | |
|---|---|---|
| KR | 20-0198600 Y1 | 10/2000 |
| KR | 20-0243049 Y1 | 10/2001 |
| KR | 20-0264770 Y1 | 2/2002 |

* cited by examiner

*Primary Examiner* — Tajash D Patel
(74) *Attorney, Agent, or Firm* — KORUS Patent, LLC; Seong Il Jeong

(57) ABSTRACT

The present invention relates generally to a cap with an exchangeable visor, and more specifically to a cap with an exchangeable visor, the cap having a cap body configured to surround the head of a person and a cap visor configured to be selectively coupled to and separated from one side of the cap body, the cap including: a rail part configured to be formed on the outer circumferential surface of the bottom of the cap body; a coupling part configured to be coupled to the visor to surround one side of the visor; and a fastening groove part configured to be coupled to one side of the coupling part, and to be engaged with the rail part in a sliding manner.

4 Claims, 4 Drawing Sheets

CAP WITH EXCHANGEABLE VISOR

CROSS-REFERENCE TO RELATED APPLICATION

This application claims the benefit of Korean Patent Application No. 10-2018-0038569 filed on Apr. 3, 2018, which is hereby incorporated by reference herein in its entirety.

BACKGROUND

1. Technical Field

The present invention relates generally to a cap with an exchangeable visor, and more specifically to a cap with an exchangeable visor, in which a visor can be easily coupled to and separated from a cap body, so that the visor and the cap body can be exchanged with a desired cap body and a desired visor, thereby enabling the creation of various types of styling and also providing unique styles.

2. Description of the Related Art

In general, caps that are worn on the heads of persons may be classified into protective caps, such as a helmet, etc., that are worn to protect the heads of persons from external impact, and fashion caps that are worn to provide various types of styling and fashion. Such a fashion cap includes a cap body configured to surround the head of a person and a cap visor configured to block sunshine, etc.

In this case, the fashion cap is configured such that the cap body and the cap visor are integrated with each other. Accordingly, there occurs the risk of injury when a ball hits the fashion cap when a user plays sports, such as soccer. In order to avoid such a risk, there are frequent cases where the fashion cap is worn backward with the cap visor directed to the head of a person. In this case, a problem arises in that the cap visor directed to the back of the head comes into contact with the neck, back, or the like of the user, and thus the user who wears the cap feels uncomfortable.

Furthermore, on a cloudy or rainy day without sunlight, the viewing angle of a user is narrowed by the cap. Accordingly, a problem occurs in that the risk of a safety-related accident increases.

In order to overcome the problem, there were proposed caps in which a cap visor could be selectively coupled to and separated from a cap body and the cap visor could be exchanged and then used. These caps are advantageous in that the cap visor can be exchanged with other visors and thus the creation of various types of styling is enabled.

However, in the conventional caps configured such that the cap visor is separated from the cap body, the configurations by which the cap visor and the cap body are selectively coupled to and separated from each other are exposed to the outside. Accordingly, the shapes of the caps are different from those of ordinary caps. Therefore, this gives consumers unfamiliar and uncomfortable feelings. As a result, the conventional caps in which a cap visor can be exchanged have not been put to practical use.

SUMMARY

The present invention has been conceived to overcome the above-described problem of the conventional technology, and an object of the present invention is to provide a new type of cap with an exchangeable visor, which includes a rail part configured to be formed on an outer circumferential surface of a bottom of the cap body, a coupling part configured to be coupled to the visor to surround one side of the visor, and a fastening groove part configured to be coupled to one side of the coupling part and to be engaged with the rail part in a sliding manner, and thus a visor can be easily and selectively coupled to and separated from a cap body, so that the visor and the cap body can be exchanged with a desired cap body and a desired visor, thereby enabling the creation of various types of styling and also providing unique styles.

In order to accomplish the above object, the present invention provides a cap with an exchangeable visor, the cap having a cap body configured to surround the head of a person and a cap visor configured to be selectively coupled to and separated from one side of the cap body, the cap including: a rail part configured to be formed on the outer circumferential surface of the bottom of the cap body; a coupling part configured to be coupled to the visor to surround one side of the visor; and a fastening groove part configured to be coupled to one side of the coupling part, and to be engaged with the rail part in a sliding manner.

The rail part may include: a body formed in a strip shape that extends in the longitudinal direction thereof; a stepped portion configured to come into contact with the outer circumferential surface of the bottom of the cap body while forming a step on one side surface of the body; a sewn portion configured to form a plurality of through holes along the center of the body in the longitudinal direction of the body, and to couple the outer circumferential surface of the bottom of the cap body and the body to each other through sewing; a protrusion portion configured to protrude from the other side surface of the body at regular intervals; and a guide portion formed to be inclined so that both side ends of the body can be coupled to one end of the fastening groove part.

The coupling part may include: a pair of plates configured to come into contact with the top and bottom of the visor; a finishing plate configured to finish first sides of the plates, and formed in a plate shape; side plates configured to be coupled to both sides of the plates, and to surround the left and right sides of the visor; and a plurality of coupling holes formed through one of the plates, and configured to enable fastening pins to be coupled thereinto.

The fastening groove part may include: a body formed to have a length corresponding to that of the first body, and configured to accommodate the first body; coupling grooves formed along one surface of the body at locations corresponding to the protrusions of the protrusion portion; and a pair of stoppers disposed at both side ends of the body, and configured to limit the sliding movement of the body coupled to the first body;

the stopper may include: a reception hole formed through the top end surface of the first body; a pin formed in a rod shape to have a predetermined length so that it can be moved inside the reception hole in a vertical direction; and a grip formed on one side of the pin, and configured to be held in order to selectively lift and lower the pin; and the pin is moved in a downward direction and accommodated between the protrusions of the protrusion portion, thereby limiting the sliding movement of the body.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

A preferred embodiment of the present invention will be described in detail below with reference to the accompanying drawings so that those having ordinary knowledge in the art to which the present invention pertains can easily practice the present invention. However, in the following description of the preferred embodiment of the present invention, when it is determined that a detailed description of a related well-known function or configuration may make the gist of the present invention unnecessarily obscure, the detailed description will be omitted.

Furthermore, throughout the drawings, the same reference symbols are assigned to parts having similar functions and operations.

In addition, throughout the specification and the claims, when any portion is described as being connected to another portion, this includes not only a case where they are directly connected to each other but also a case where they are indirectly connected to each other with a third component interposed therebetween. Furthermore, when any portion is described as including any component, this is not intended to exclude another component, but is intended to include another component, unless particularly described to the contrary.

Furthermore, the terms "upper" and "lower" used herein refer to the relative directions of components based on a case where a user is in a normal upright position with a cap body worn on the head of the user.

A cap with an exchangeable visor according to a preferred embodiment of the present invention will be described in detail below with reference to the accompanying drawings.

Figure 1:
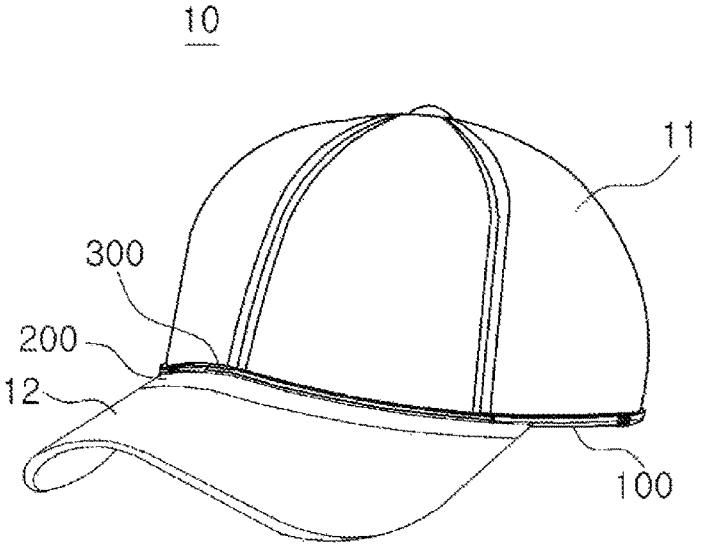
FIG. 1 is a perspective view schematically showing the appearance of a cap with an exchangeable visor according to an embodiment of the present invention.
Figure 2:
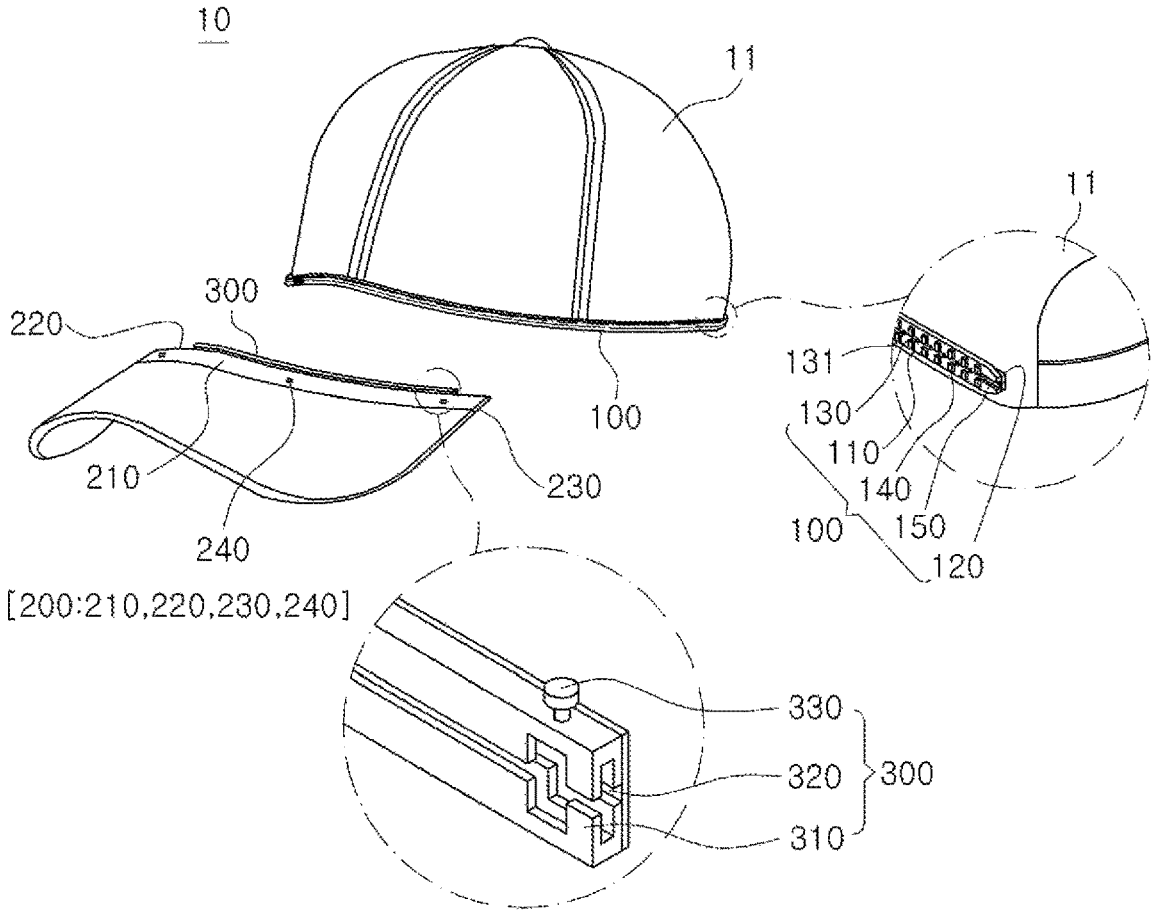
FIG. 2 is an exploded perspective view of FIG. 1.
Figure 3:
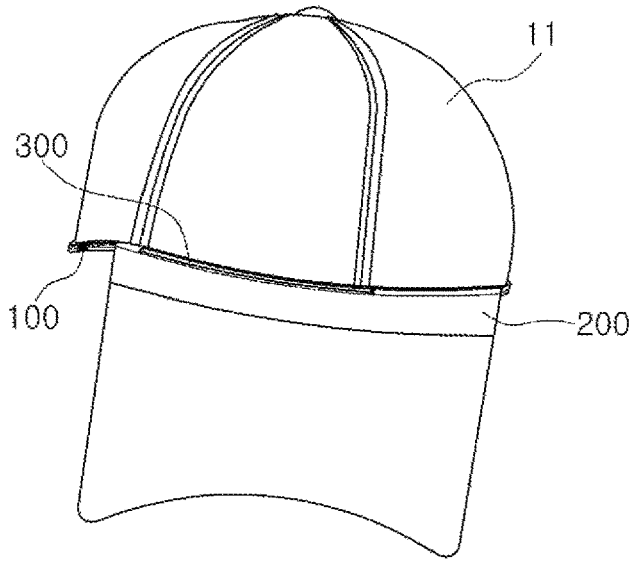
FIG. 3 is a perspective view showing a state in which a visor has slid from the outer circumferential surface of the bottom of a cap body to one side.
Figure 4:
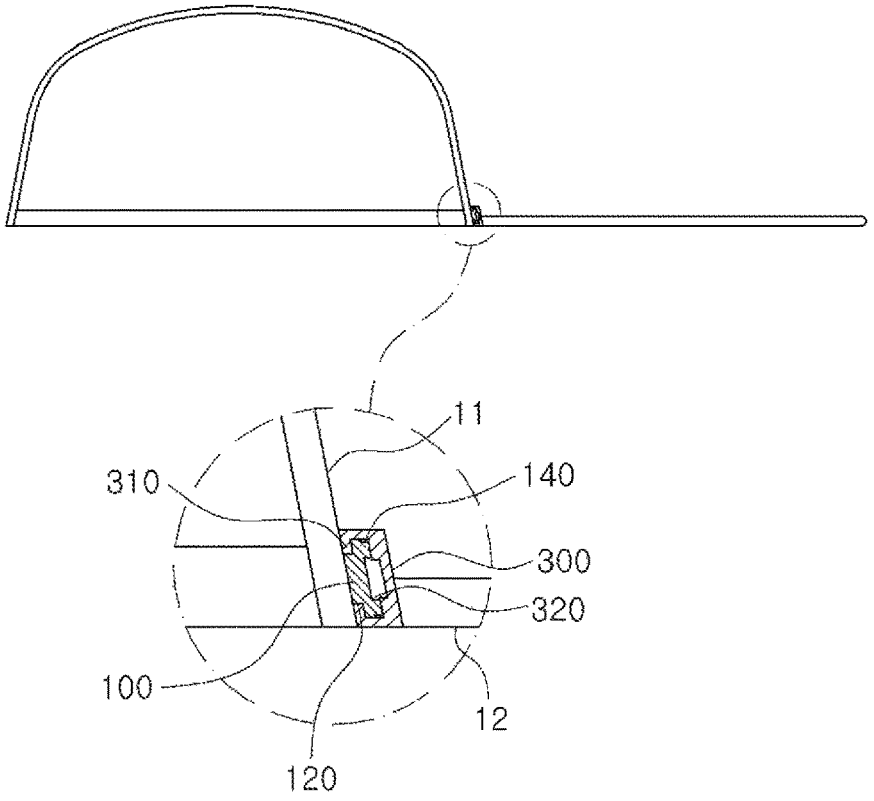
FIG. 4 is a sectional view of FIG. 1.
Figure 5:
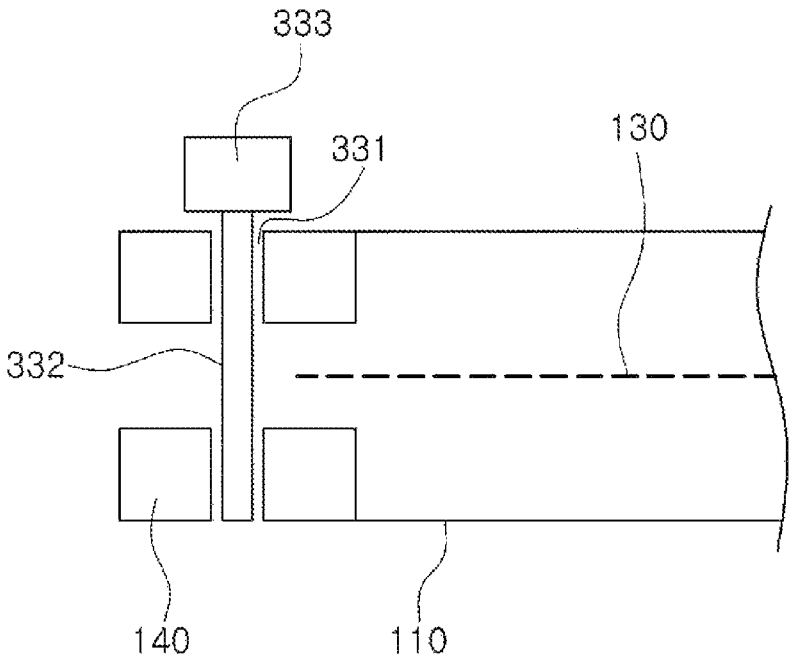
FIG. 5 is a sectional view showing a stopper according to the present invention.
Figure 6:
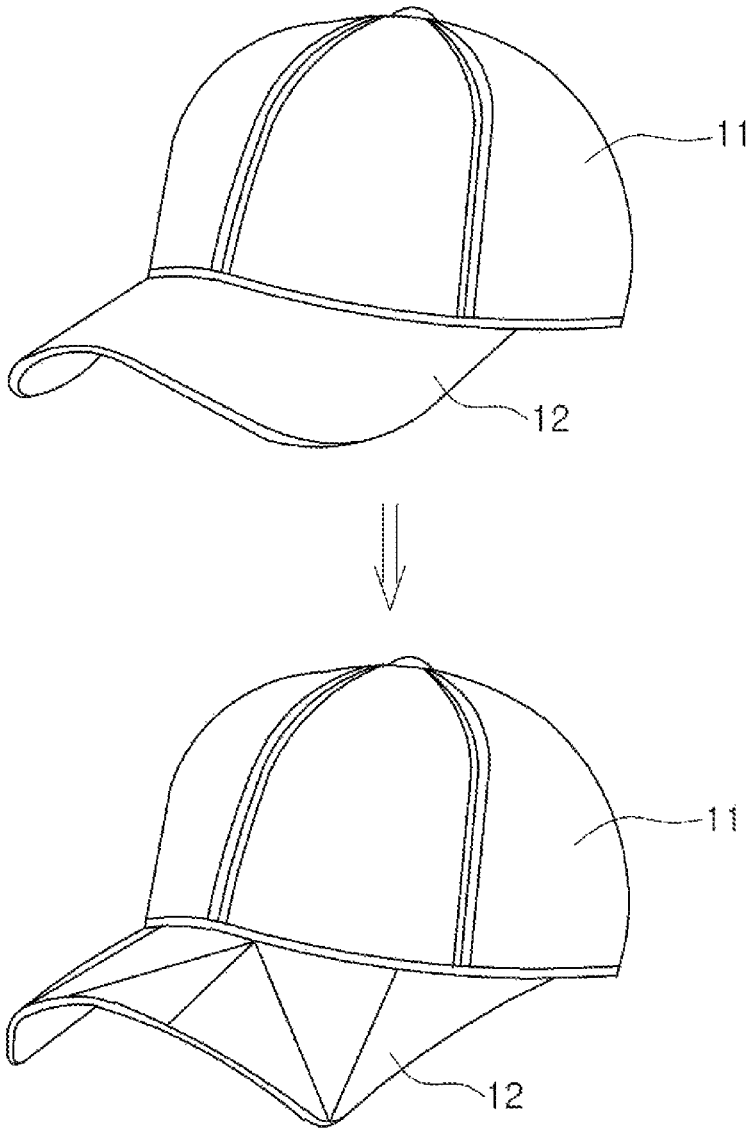
FIG. 6 a view showing an example of a state in which a cap body and a visor according to the present invention have been exchanged.

FIG. 1 is a perspective view schematically showing the appearance of the cap with an exchangeable visor according to the embodiment of the present invention, FIG. 2 is an exploded perspective view of FIG. 1, FIG. 3 is a perspective view showing a state in which a visor has slid from the outer circumferential surface of the bottom of a cap body to one side, FIG. 4 is a sectional view of FIG. 1, FIG. 5 is a sectional view showing a stopper according to the present invention, and FIG. 6 a view showing an example of a state in which a cap body and a visor according to the present invention have been exchanged.

As shown in FIG. 1, the cap 10 with an exchangeable visor according to the embodiment of the present invention, which has a cap body 11 configured to surround the head of a person and a cap visor 12 configured to be selectively coupled to and separated from one side of the cap body 11, includes: a rail part 100 configured to be formed along the outer circumferential surface of the bottom of the cap body 11; a coupling part 200 configured to be coupled to the cap visor 12 to surround one side of the cap visor 12; and a fastening groove part 300 configured to be coupled to one side of the coupling part 200, and to be engaged with the rail part in a sliding manner.

In this case, the cap body 11 functions to surround the head of a person. The cap body 11 is worn on and fastened to a head, is made of a material including fiber, and is formed to correspond to the shape of the head.

The visor 12 is coupled to one side of the outer circumferential surface of the cap body 11, and functions to block sunshine and to protect the face of a user from direct sunlight.

Furthermore, although the visor 12 is shown as being formed in a curved shape in the accompanying drawings, the visor 12 may be formed in a flat shape as well as in a curved shape. Furthermore, the fastening groove part 300 may be fabricated to correspond to the curved or flat shape of the visor 12 when the fastening groove part 300 to be described later is coupled to one side of the visor 12.

Referring to FIGS. 1 and 2, the rail part 100 is formed along the outer circumferential surface of the bottom of the cap body 11, and functions to be engaged with the fastening groove part 300 in a sliding manner and to enable the visor 12 to be coupled. For this purpose, the rail part 100 includes a body 110, a stepped portion 120, a sewn portion 130, a protrusion portion 140, and a guide portion 150.

The body 110 is formed in a strip shape that extends in the longitudinal direction thereof. The body 110 is made of a plastic or rubber material, and is formed along the outer circumferential surface of the bottom of the cap body 11 in order to prevent the shape of the appearance of the cap body 11 from being deformed.

Furthermore, the body 110 is formed to a predetermined height, and supports the visor 12 to be described later when it is coupled to the fastening groove part 300. Furthermore, the body 110 is preferably utilized as an element that is formed on the bottom of the outer circumferential surface of the cap body 11 and that is used to create creative design.

Referring to FIG. 4, the stepped portion 120 comes into contact with the outer circumferential surface of the bottom of the cap body 11 while forming a step on one side surface of the body 110.

In other words, the stepped portion 120 protrudes from one side surface of the body 110 in a stepped manner, and the protruding surface of the stepped portion 120 comes into contact with the outer circumferential surface of the cap body 11. In particular, it will be apparent that the stepped portion 120 forms a step in order to enable the body 110 to slide in the state of having been completely accommodated in the fastening groove part 300 in the process in which the stepped portion 120 is coupled to the fastening groove part 300.

Referring to FIGS. 1 and 3, the sewn portion 130 forms a plurality of through holes 131 along the center of the body 110 in the longitudinal direction of the body 110, and functions to couple the stepped portion 120 to the outer circumferential surface of the bottom of the cap body 11 through sewing.

The sewn portion 130 minimizes the defect rate resulting from bond adhesion, and secures the coupling between the cap body 11 and the body 110.

The protrusion portion 140 protrudes along the other side surface of the body 110 at regular intervals.

In other words, the protrusion portion 140 includes a plurality of protrusions that protrudes in vertical shapes along the other side surface of the body 110 and that are formed at regular intervals. Furthermore, the protrusion portion 140 has a shape in which its upper and lower portions are made to protrude to be spaced apart from each other on the other side surface of the body 110 by the sewn portion 130.

Furthermore, the protrusion portion 140 is configured such that a space is formed between its neighboring protrusions, and thus a pin 332 to be described later can be accommodated within the space.

Furthermore, the protrusion portion 140 may be formed in triangular prisms in which both sides of each of the prisms are inclined in protruding directions based on a vertical axis. The reason for this is that when the fastening groove part 300 is engaged with the rail part 100 in a sliding manner, the fastening groove part 300 is coupled to the coupling grooves 320 formed on the fastening groove part 300 and thus the lateral sliding movement of the fastening groove part 300 is minimized, thereby enabling a state in which the visor 12 has been coupled to the outer circumferential surface of the cap body 110 to be maintained.

Furthermore, it will be apparent that when a user performs sliding movement in a lateral direction while holding the visor 12, the protrusion portion 140 is separated from the coupling grooves 320.

The guide portion 150 is formed to be inclined so that both side ends of the body 110 can be coupled to one end of the fastening groove part 300. In other words, the guide portion 150 is formed such that its upper and lower portions are inclined in sharp shapes with respect to both side ends of the body 110. This facilitates the insertion of the one end of the fastening groove part 300 into the body 110.

Referring to FIGS. 1 and 2, the coupling part 200 performs coupling to surround one side of the visor 12. The coupling part 200 functions to enable the fastening groove part 300 to be engaged with the rail part 200 in such a manner that the fastening groove part 300 is coupled to one side of the coupling part 200. For this purpose, the coupling part 200 includes a pair of plates 210, a finishing plate 220, side plates 230, and coupling holes 240.

The plates 210 are formed in plate shapes in order to come into contact with the top and bottom of the visor 12.

In this case, the plates 210 may be formed to have a predetermined thickness. One side of each of the plates 210 may be formed to be curved in accordance with the shape of the outer circumferential surface of the bottom of the cap body 11, and the other side thereof may be formed to correspond to the shape of the back end of the visor 12.

The finishing plate 220 is formed in a plate shape to finish first sides of the plates 210, and functions to enable the visor 12 to be coupled to the rail part 100 in such a manner that the fastening groove part 300 is coupled to the first sides of the plates 210.

The side plates 230 function to be coupled to both sides of the plates 210 and to surround the right and left sides of the visor 12.

The plurality of coupling holes 240 is formed through one of the plates 210, and enables fastening pins to be coupled thereinto. In other words, the plurality of coupling holes 240 is formed through one of the plates 210 in contact with the top and bottom of one side of the visor 12, and enables the fastening pins to couple the visor 12 and the plates 210 to one another.

Referring to FIG. 2, the fastening groove part 300 is coupled to one side of the coupling part 200, and is engaged with the rail part 100 in a sliding manner. For this purpose, the fastening groove part 300 includes a body 310, coupling grooves 320, and a pair of stoppers 330.

The body 310 is formed to have a length corresponding to that of the body 110, and functions to accommodate the body 110.

In other words, the body 310 includes a plate configured to be formed in a strip shape and to extend in the longitudinal direction thereof, walls configured to extend from the edges of the top and bottom of the plate by a predetermined distance in one direction, and a pair of bent plates configured to be bent inward from two side ends of the walls, respectively.

In this case, the bent plates are spaced apart from each other while facing each other. The reason for this is to enable the body 310 to come into contact with the top and bottom of the stepped portion 120 and to slide. It will be apparent that the bent plates are spaced apart from each other because the stepped portion 120 is sewn to the cap body 11 and thus the body 310 needs to be opened by a distance corresponding to the space of the stepped portion 120.

The coupling grooves 320 are formed along one surface of the body 310 at locations corresponding to the protrusions of the protrusion portion 140.

In other words, the coupling grooves 320 are formed in concave grooves on one surface of the body 310, and the protrusions of the protrusion portion 140 protruding from the other side surface of the body 310 are fitted into the coupling grooves 320 as the body 310 is moved when the body 310 and the body 110 are coupled to each other in a sliding manner.

Accordingly, the coupling grooves 320 function to maintain the coupling force between the body 310 and the body 110.

As described above, the fastening groove part 300 is engaged with the rail part 100 in a sliding manner, and moves along the rail part 100, and is selectively engaged with and separated from the rail part 100, as shown in FIG. 6. Accordingly, the present invention has an advantage in that the cap body 11 and the visor 12 can be easily separated from and coupled to each other.

Furthermore, since the cap body 11 and the visor 12 can be separated from and coupled to each other, a user may create desired various designs in such a manner that a plurality of cap bodies and a plurality of visors are provided and different cap bodies and different visors are coupled to each other.

Referring to FIG. 5, the pair of stoppers 330 are disposed at both side ends of the body 310, and limits the sliding movement of the body 310 coupled to the body 110. For this purpose, each of the pair of stoppers 330 includes a reception hole 331, a pin 332, and a grip 333.

The reception hole 331 is formed through the top end surface of the body 310, and functions to receive the pin 332 to be described below.

The pin 332 is formed in a rod shape to have a predetermined length so that the pin 332 can be moved inside the reception hole 331 in a vertical direction.

In this case, the pin 332 is moved in a downward direction and accommodated between the protrusions of the protrusion portion 140, thereby limiting the sliding movement of the body 310.

In other words, the pin 332 is located inside the reception hole 331 formed in the body 310, is located between the protrusions of the protrusion portion 140 formed on the other side surface of the body 110, and enables the visor 12 to be securely coupled to the cap body 11 by limiting the movement of the body 310.

The grip 333 is formed on one side of the pin 332, and is preferably formed to have a size larger than the diameter of the pin 332 so that a user can hold the pin 332 in order to selectively lift and lower the pin 332.

Meanwhile, the cap 10 with an exchangeable visor according to the embodiment of the present invention may be fabricated by forming the fastening groove part 300 configured to be engaged with the rail part 100 on one side of the visor 12 through injection molding without the configuration of the coupling part 200 adapted to be coupled to the visor 12 to surround one side of the visor 12.

The cap with an exchangeable visor according to the present invention is advantageous in that the cap body and the visor can be easily and selectively coupled to and separated from each other, so that the cap body and the visor can be exchanged with a desired cap body and a desired visor, with the result that the creation of various types of styles is enabled, thereby increasing the satisfaction of a user by meeting the personality of the user who pursues unique styling.

Furthermore, the cap with an exchangeable visor according to the present invention is advantageous in that the visor can slide from the outer circumferential surface of the bottom of the cap body to one side, so that only the visor can be moved without the movement of the cap body, thereby providing convenience to a user who pursues hipster styling.

Moreover, the cap with an exchangeable visor according to the present invention is advantageous in that the stopper is provided, so that the visor can be prevented from being separated and removed from the cap body by means of a simple structure.

Although the preferred embodiment of the present invention has been described in the detailed description of the present invention above, this is intended to describe the most preferred embodiment of the present invention as an example, but is not intended to limit the present invention. Furthermore, it will be apparent to those having ordinary knowledge in the art to which the present invention pertains that various modifications and alterations may be made without departing from the technical spirit of the present invention.

Therefore, the range of rights of the present invention is not limited to the above-described embodiment, but the present invention may be implemented as various forms of embodiments within the attached claims. Furthermore, various ranges within which those having ordinary knowledge in the art to which the present invention pertains can make modifications and alterations without departing from the gist of the present invention claimed in the attached claims are viewed as falling within the scope of the attached claims.

What is claimed is:

1. A cap with an exchangeable visor, the cap having a cap body configured to surround a head of a person and a cap visor configured to be selectively coupled to and separated from one side of the cap body, the cap comprising:

a rail part configured to be formed on an outer circumferential surface of a bottom of the cap body;

a coupling part configured to be coupled to the visor to surround one side of the visor; and a fastening groove part, one side of the fastening groove part being configured to be coupled to one side of the coupling part, and other opposite side of the fastening groove part being engaged with the rail part in a sliding manner.

2. The cap of claim 1, wherein the rail part comprises:

a body formed in a strip shape that extends in a longitudinal direction thereof;

a stepped portion configured to come into contact with the outer circumferential surface of the bottom of the cap body while forming a step on one side surface of the body;

a sewn portion configured to form a plurality of through holes along a center of the body in a longitudinal direction of the body, and to couple the outer circumferential surface of the bottom of the cap body and the body to each other through sewing;

a protrusion portion configured to protrude from an opposite side surface of the body at regular intervals; and a guide portion formed to be inclined so that both side ends of the body can be coupled to one end of the fastening groove part.

3. The cap of claim 1, wherein the coupling part comprises:

a pair of plates configured to come into contact with a top and bottom of the visor;

a finishing plate configured to finish first sides of the plates, and formed in a plate shape;

side plates configured to be coupled to both sides of the plates, and to surround left and right sides of the visor; and a plurality of coupling holes formed through one of the plates, and configured to enable fastening pins to be coupled thereinto.

4. The cap of claim 2, wherein:

the fastening groove part comprises:

a body formed to have a length corresponding to that of the first body, and configured to accommodate the first body;

coupling grooves formed along one surface of the body at locations corresponding to protrusions of the protrusion portion; and a pair of stoppers disposed at both side ends of the body, and configured to limit sliding movement of the body coupled to the first body;

the stopper comprises:

a reception hole formed through a top end surface of the first body;

a pin formed in a rod shape to have a predetermined length so that it can be moved inside the reception hole in a vertical direction; and a grip formed on one side of the pin, and configured to be held in order to selectively lift and lower the pin; and the pin is moved in a downward direction and accommodated between the protrusions of the protrusion portion, thereby limiting the sliding movement of the body.

* * * * *